US011965326B2

(12) United States Patent
Simonsen

(10) Patent No.: US 11,965,326 B2
(45) Date of Patent: Apr. 23, 2024

(54) CANTILEVERED AND DECOUPLED FRAMING

(71) Applicant: David John Simonsen, Redding, CA (US)

(72) Inventor: David John Simonsen, Redding, CA (US)

( * ) Notice: Subject to any disclaimer, the term of this patent is extended or adjusted under 35 U.S.C. 154(b) by 193 days.

(21) Appl. No.: 17/576,949

(22) Filed: Jan. 16, 2022

(65) Prior Publication Data

US 2022/0251822 A1 Aug. 11, 2022

Related U.S. Application Data

(60) Provisional application No. 63/137,735, filed on Jan. 15, 2021.

(51) Int. Cl.
*E04B 1/24* (2006.01)

(52) U.S. Cl.
CPC .... *E04B 1/2403* (2013.01); *E04B 2001/2415* (2013.01); *E04B 2001/2439* (2013.01)

(58) Field of Classification Search
CPC ..... E04B 1/2403; E04B 2001/2415; E04B 2001/2439; E04B 2/789; E04B 2/767; E04B 2/7457; E04B 2/7412
See application file for complete search history.

(56) References Cited

U.S. PATENT DOCUMENTS

| | | | | |
|---|---|---|---|---|
| 2,997,141 | A * | 8/1961 | Wetzler | F16B 12/06 5/186.1 |
| 4,455,806 | A * | 6/1984 | Rice | E04C 3/07 52/404.1 |
| 5,553,437 | A * | 9/1996 | Navon | E04C 3/07 52/837 |
| 5,592,796 | A * | 1/1997 | Landers | E04B 2/7457 52/483.1 |
| 5,647,186 | A * | 7/1997 | Donaldson | E04B 2/60 52/656.1 |
| 6,397,550 | B1 * | 6/2002 | Walker | E04C 3/07 52/836 |
| 6,436,552 | B1 * | 8/2002 | Walker | E04C 3/09 428/603 |
| 8,020,352 | B2 * | 9/2011 | Ahearn | E04B 2/7457 52/241 |
| 8,181,423 | B2 * | 5/2012 | Bartlett | E04C 3/07 52/690 |
| 8,499,512 | B2 * | 8/2013 | Pilz | E04B 1/24 52/235 |
| 10,024,059 | B2 * | 7/2018 | Mitchell | E04C 3/07 |
| 10,184,250 | B1 * | 1/2019 | Abdel-Rahman | E04C 3/07 |
| 10,253,498 | B2 * | 4/2019 | Stevens | E04B 2/60 |
| 10,907,344 | B2 * | 2/2021 | Jung | E04B 2/7457 |
| 2002/0108345 | A1 * | 8/2002 | Walker | E04C 3/07 52/842 |
| 2003/0163970 | A1 * | 9/2003 | Moore | E04B 2/789 52/846 |
| 2007/0051059 | A1 * | 3/2007 | Ahearn | E04B 2/7457 52/293.3 |

(Continued)

*Primary Examiner* — Rodney Mintz

(57) ABSTRACT

Steel Framing members for use in load bearing and non-load bearing applications which use less steel, yet provide structural integrity with increased acoustic, thermal, and moisture control performances while supporting cantilevered loads outside of the wall assembly and having higher pull-out and strip resistance of fasteners.

5 Claims, 19 Drawing Sheets

(56) References Cited

U.S. PATENT DOCUMENTS

| | | | | |
|---|---|---|---|---|
| 2009/0178369 | A1* | 7/2009 | Pilz | E04B 1/24 52/656.1 |
| 2011/0162320 | A1* | 7/2011 | Bartlett | E04B 5/10 52/843 |
| 2017/0241137 | A1* | 8/2017 | Stevens | E04C 3/07 |
| 2018/0171634 | A1* | 6/2018 | Mitchell | E04C 3/32 |
| 2018/0328020 | A1* | 11/2018 | Jung | E04B 2/7457 |
| 2021/0230863 | A1* | 7/2021 | Simonsen | E04F 13/0832 |
| 2023/0088085 | A1* | 3/2023 | Simonsen | E04C 3/09 52/846 |
| 2023/0392371 | A1* | 12/2023 | Simonsen | E04B 2/58 |

* cited by examiner

CANTILEVERED AND DECOUPLED FRAMING

CROSS REFERENCES TO RELATED APPLICATIONS

The present application claims the benefit of U.S. Provisional Patent Application Ser. No. 63/137,735 filed Jan. 15, 2021.

BACKGROUND OF THE INVENTION

The present invention relates to novel and useful dual-walled stud and track systems with methods of installation for framing buildings and structures of all types.

In the past there has been little change in the structural and non-structural steel framing market since its inception as an alternative to wood. The steel studs used today are essentially the same design and serve the same functions as when they were first introduced as a "C" shape.

The present invention relates to Cantilevered and Decoupled Framing Systems that require less materials and have high structural, thermal, and acoustic performances allowing for new and different mounting options of both interior and exterior cantilevered products such as televisions for interiors and façade systems for exterior applications. They will provide anti-reversal characteristics for fasteners connected to them, and vibration (sound) absorption and blocking benefits. They will also provide a means for less thermal, water, air and moisture transfer into the building by requiring fewer mechanical fasteners to penetrate the weather barrier on the exterior of buildings.

BRIEF SUMMARY OF THE INVENTION

In accordance with the present application, novel and useful Cantilevered, Decoupled and Resilient Framing Systems are herein provided that include specially shaped studs with multiple flanges, multi-material studs (composite studs), and associated top and bottom tracks to match.

The steel studs of this invention have at least one additional nailing wall which provides additional penetration for mounting screws and allowing multiple connection points on the fastener so that they may become "cantilevered" and able to support loads that a single walled stud cannot. All variations of this concept include at least one side of the stud having more than one dual nailing flange. The steel studs may be fabricated and formed of a material such as galvanized steel sheet metal or from similar material in coil form and produced on roll forming machines with various in-line punches, dies, top and bottom rollers, wheels, shears, etc. They may be made with multiple machines such as a turret press and brake press. If the additional flange is to be an attachment it may be attached to a stud using any mechanical means such as a spot welder, self-drilling screws, rivets, adhesives, clinching tools, etc. The steel studs will have service holes, slots, indentations, bends, louvers, ribs, serrations, embossments and other structural features which will be used for insertion of conduits, pipes, tubes, insulation and other mechanisms through, for assisting in the alignment of fasteners during installation to guide the fastener and assist with pull-out strength and strip resistance, to provide overall increases in structural strength, to increase thermal and/or acoustic performances, and to provide structural benefits in special applications such as blast and seismic.

The studs may be filled with an insulation material during or after manufacturing such as by inserting insulation into stud cavities during roll-forming, spraying foams into stud cavities during the manufacturing process including filling plastic coverings such as heat shrink tubing which will wrap the stud to eliminate air gaps within the stud. The studs may have portions of it removed, such as holes and slots, so as to minimize vibration and/or thermal transfer.

The tracks may be made of metal such as galvanized steel, or of a combination of plastic shapes which include the flanges and having an inserted or attached metal structural support which allows for minimal thermal and acoustic transfer at the top and bottom locations of the studs. The steel tracks may be fabricated and formed of a material such as galvanized steel sheet metal or from the same material in coil form and produced on roll forming machines with various in-line punches, dies, top and bottom rollers, wheels, shears, etc. They may also be made with multiple machines such as a turret press and brake press. Extruded plastic may be used with steel, each having some or all attributes of a standard track, and where the steel inserts into plastic tangs, prongs or other self-gripping/anti-reversal mechanisms for permanent fixing. The plastic and steel may also be attached to an additional steel sheet using any mechanical means such as a self-drilling screws, rivets, adhesives, by use of clinching tools that join the dissimilar materials, etc. All tracks of this invention may have holes, slots, indentations, bends, ribs, and other features to the studs, and which may have 8-inch center locations marked or indented for easy placement of similarly marked or indented studs which may allow studs to enter but not easily leave a location because of "locking-in" to such a location. Indentations made by stamping may also have holes made during the same process and assist in fastener installation, allowing for easier fastener penetration between studs and tracks.

Isolators may be made of materials such as plastics, polyamides, rubber, fiber reinforced plastics, and other materials which absorb vibration, provide thermal break characteristics, and/or which have sufficient strength to hold components together and/or allow for structural integrity. Isolators may be extruded, pultruded, injection molded or otherwise manufactured for their intended purposes including being made using milling machines, 3D printing, etc. The isolator material, such as when used in the tracks, will have holes smaller than the diameter of fasteners to assist in preventing these fasteners from backing out by "gripping" the fasteners once installed.

The insulation used with the framing members of this invention will assist in keeping the stud's intended shape by use of its compressive properties, allowing some deflection but together with the stud springing back to their original shape after pressure is removed. The insulation may be materials such as foam board, or high, medium or low-density glass or rock mineral wool by manufacturers such as Owens Corning and ROCKWOOL. The rigidity and compressive strength of the insulation will help prevent movement of the installed framing members during fastener installation, insulation installation, and façade mounting hardware installation.

Braces which will connect more than one stud or portions of studs together will be made of materials such as galvanized steel, plastic or rubber materials. When made with metal it may be made using a turret press and a brake press, with a progressive punch assembly which makes the part in one motion from a blank, or via 3D printing. If made with plastic or rubber-like materials it may be made by injection molding processes or 3D printing. Braces will be used to help stiffen independent studs which are mounted in separate tracks, areas of the same track, or studs which are mounted directly to a floor or other substrate. Braces will also be used for mounting conductors, conduits, pipes, and other components on top and elevate them off the ground or to a specific level.

It may be apparent that novel and useful Cantilevered, Decoupled and Resilient Framing Systems have been hereinabove described which work and are used in a manner not consistent with conventional products and methods.

It is therefore an object of the present application to provide Cantilevered, Decoupled and Resilient Framing Systems which provide a stud with multiple flanges for fasteners to penetrate and prevent movement of the fasteners, prevent deformation of the stud, and prevent fasteners from backing or stripping out when penetrating more than one flange.

Another object of the present application is Cantilevered, Decoupled and Resilient Framing Systems with a composite stud made as a single unit, or as multiple components which when combined together create a single stud architecture.

Another object of the present application is Cantilevered, Decoupled and Resilient Framing Systems which provide for the compressive strength of insulation to help prevent stud components from moving when pressure is applied to them, such as from fasteners.

Another object of the present application is Cantilevered, Decoupled and Resilient Framing Systems which provide a fastener which takes onto itself tensive, compressive, bending, shear and other forces which may otherwise be exerted to a sub-girt and/or the stud, because of having multiple flanges to support the fasteners.

Another object of the present application is Cantilevered, Decoupled and Resilient Framing Systems with isolators shaped and positioned onto stud components to help prevent the flanges of the stud from moving when loads are applied to them.

Another object of the present application is Cantilevered, Decoupled and Resilient Framing Systems with isolators which, once installed or attached will not easily be removed, by means such as one-way installation means shown in the following drawings.

Another object of the present application is Cantilevered, Decoupled and Resilient Framing Systems which eliminate the need for resilient channels and/or resilient clips for noise reduction.

Another object of the present application is Cantilevered, Decoupled and Resilient Framing Systems which provides for insulation to be installed continuously within stud cavities without other materials supporting the insulation.

Another object of the present application is Cantilevered, Decoupled and Resilient Framing Systems which increase the ease and speed of installation of a sound blocking/absorbing wall by eliminating resilient clips and resilient channels.

Another object of the present application is Cantilevered, Decoupled and Resilient Framing Systems which provides air gaps between the sheetrock and the insulation to help isolate and absorb vibration as well as act as a moisture control mechanism to help control the movement of moisture within a wall assembly.

Another object of the present application is Cantilevered, Decoupled and Resilient Framing Systems which provide tracks with stud positioning shapes such as continuous indentations, on as many as 4 sides of the track or more, which fit indentations of the respective studs so that the studs can't easily move once installed, particularly decoupled studs.

Another object of the present application is Cantilevered, Decoupled and Resilient Framing Systems which provide studs which can mount on the outside of the tracks fully or partially, and which use the tracks to maintain alignment by the studs having slots or protrusions which match mating areas of the track flanges.

Another object of the present application is Cantilevered, Decoupled and Resilient Framing Systems which provide studs and tracks that interconnect and don't allow further movement once installed so that mechanical fasteners aren't required until drywall is installed.

Another object of the present application is Cantilevered, Decoupled and Resilient Framing Systems which provide bends in the stud made by use of aligned slots or dents which allow bends to be made along the alignment using rollers in a roll forming process which don't require a bottom forming roller to bend the flanges.

Another object of the present application is Cantilevered, Decoupled and Resilient Framing Systems which provide a stud with punched "tabs" which may be pushed into a slot of the stud via rollers in a roll forming process to bend the tabs and prevent movement of stud components once bent, increasing the strength of the stud.

Another object of the present application is Cantilevered, Decoupled and Resilient Framing Systems which provide insulation installed as a stud component, and where the insulation consumes air gaps within the formed stud.

Another object of the present application is Cantilevered, Decoupled and Resilient Framing Systems which provides more than one stud component to snap inside another to form a "box" stud architecture for increased strength.

Another object of the present application is Cantilevered, Decoupled and Resilient Framing Systems in which the stud shape doubles as the track, minimizing the number of components required to build a wall to a single component not including fasteners.

Another object of the present application is Cantilevered, Decoupled and Resilient Framing Systems which have an architecture similar to purlins for applications not normally associated with studs, such as in metal buildings, utilizing the same processes and procedures as the stud.

Another object of the present application is Cantilevered, Decoupled and Resilient Framing Systems with separated multi-walled flanges which only require a different width track and brace to make a wider wall assembly.

Another object of the present application is Cantilevered, Decoupled and Resilient Framing Systems which provides a gap between the drywall and the insulation which can be filled with additional insulation to what's installed between the webs of the studs.

Another object of the present application is Cantilevered, Decoupled and Resilient Framing Systems which provide true "continuous insulation" for walls which currently doesn't exist.

Another object of the present application is Cantilevered, Decoupled and Resilient Framing Systems which provide more than one nailing flange so that continuous insulation may be mounted on rooftops where it currently isn't possible because of load conditions, such as in metal buildings.

Another object of the present application is Cantilevered, Decoupled and Resilient Framing Systems which utilize the aligned slots (obround holes) as openings to run structural straps or cables through to provide shear and/or stiffness for the studs and wall assembly inside the flanges of the stud flange components.

Another object of the present application is Cantilevered, Decoupled and Resilient Framing Systems with adhesives used to combine products which help with structural, acoustic and/or thermal performances.

Another object of the present application is Cantilevered, Decoupled and Resilient Framing Systems with aligned indentations which help keep insulation within the cavities of the studs while allowing for easier bending along the indentations.

Another object of the present application is Cantilevered, Decoupled and Resilient Framing Systems which utilizes pem nuts installed into the flanges to allow for adjustment of fasteners when mounting materials such as façade mounting systems.

The invention possesses other objects or advantages especially with concerns to characteristics and features thereof which will become apparent as the specification continues.

BRIEF DESCRIPTION OF THE DRAWINGS

FIG. 21 is a 3D isometric plan view of a section of stud of the present invention that is made from a single sheet of metal. Substantially cut insulation may be inserted into the cavity of the stud prior to the final bend to match the location of the male arm and tabs so that they pass through the insulation with little resistance allowing the tabs to enter a slot in the opposite wall of the stud and be bent over. The tabs would be bent to match a radius of the final bend location so that there is minimal disturbance of the insulation when passing through.

FIG. 23B is a 3D isometric plan view of the stud of FIG. 23 shown as an embodiment of this invention, not requiring insulation impaling pins and one of the easiest roll formed products to manufacture and make different gauge studs with.

Figure 1:
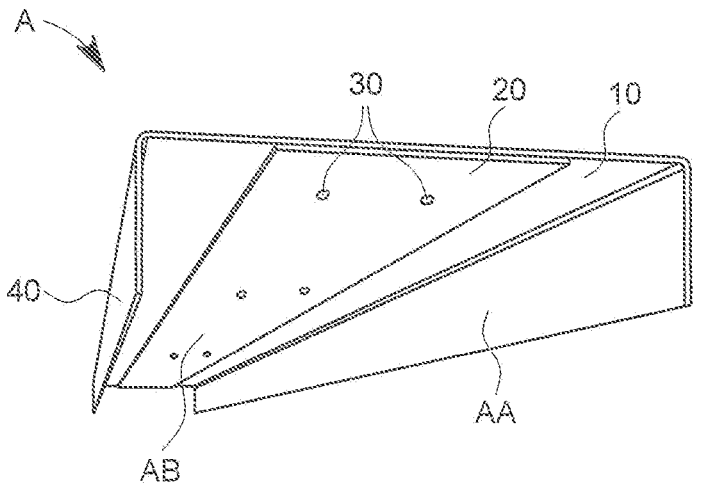
FIG. 1 is a 3D elevation isometric view of the preferred embodiment of a track.

For a better understanding of the invention of this application, reference is made to the following detailed description of the embodiments thereof which should be referenced to the prior described drawings.

DETAILED DESCRIPTION OF THE INVENTION

Various aspects of the present application will evolve from the following detailed description of the embodiments thereof which should be taken in conjunction with the prior described drawings.

Embodiments of the invention are identified by an upper-case letter with an additional upper-case letter for components that comprise the embodiment. Elements of the invention are identified by reference character 10.

With reference to FIG. 1, preferred embodiment track A assembly is shown including channel AA and support AB. Track A is comprised of web 10 and flanges 40. Support AB is comprised of body 20 which may be flat or have flanges or ribs to increase its rigidity (not shown). Connections 30 are made using a mechanical means such as clinching or riveting.

Figure 2:
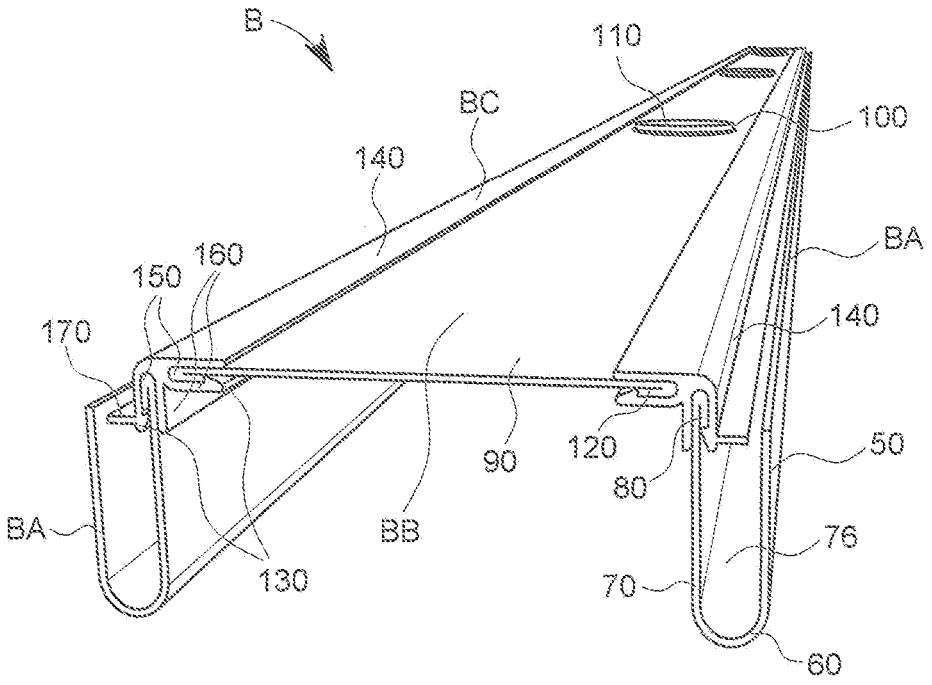
FIG. 2 is a 3D isometric plan view of a stud of present invention.

Referring now to FIG. 2, stud B includes nailing flange BA, web BB and isolator BC. Nailing flange BA has outer nailing flange 50, return 60, inner flange 70, and hem 80 where space 76 is created between. One nailing flange BA is located on each side of stud B. Web BB has body 90, flange 100, holes 110 and hems 120. Isolator BC is comprised of snap-locks 130 that are forced open to spring shut around hems 80 and hems 120 so that it is not easily removeable. Walls 140 and walls 160 support snap-locks 130 and create gaps 150 to snugly fit hems 80 and hems 120. Leg 170 prevents outer nailing flange 50 from being pushed beyond contacting it. When components BA, BB and BC are snapped together they comprise stud B as shown. Leg 170 may be used to hold insulation (not shown) within space 76.

Figure 3:
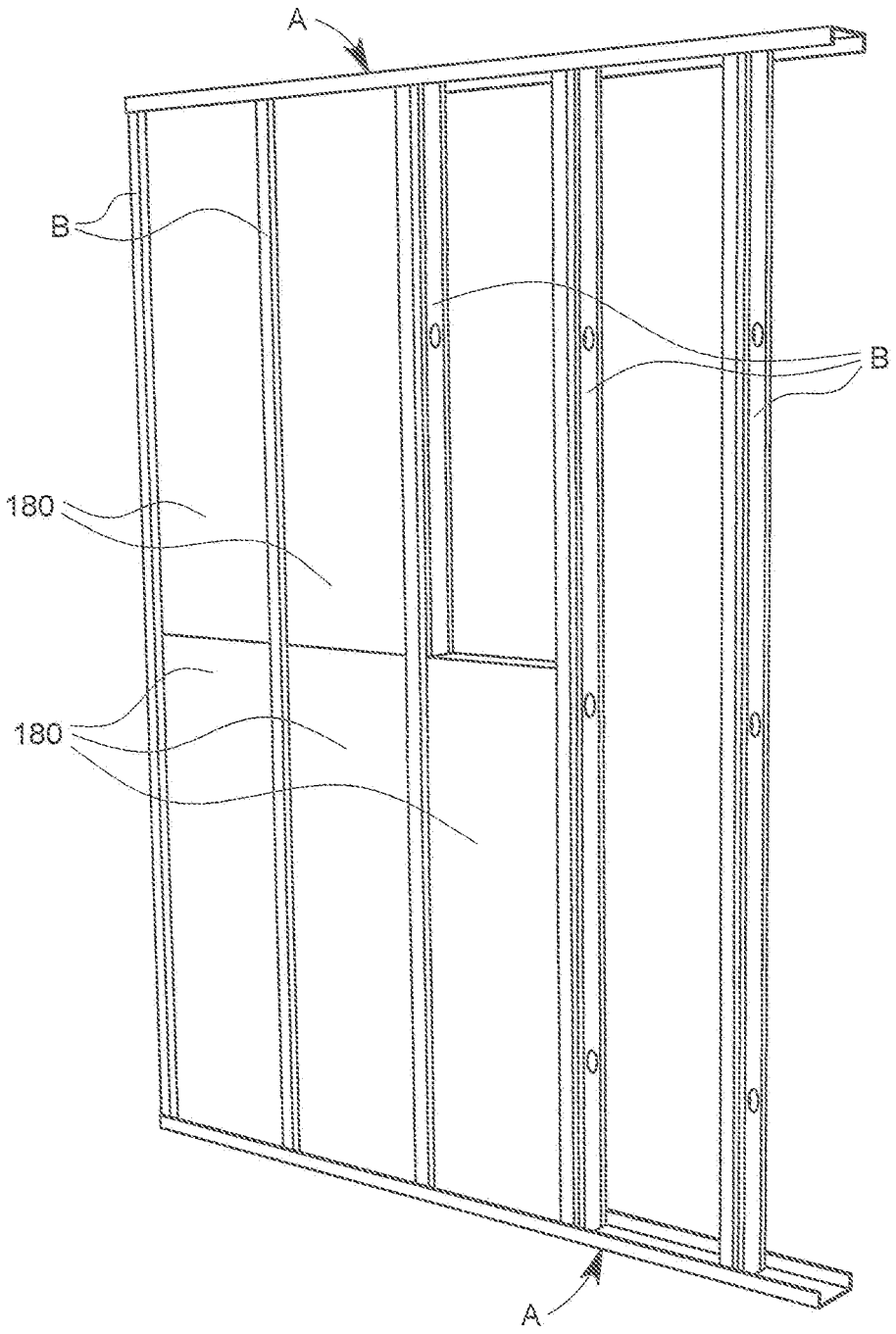
FIG. 3 is a 3D elevation isometric view of the track of FIG. 1 and the stud of Fig. assembled as a wall with insulation installed between the studs.

FIG. 3 shows tracks A and studs B in a wall assembly with insulation 180 installed between the studs. Fasteners not shown connecting track A and stud B together. Track A may be used top and bottom of a wall assembly.

Figure 4:
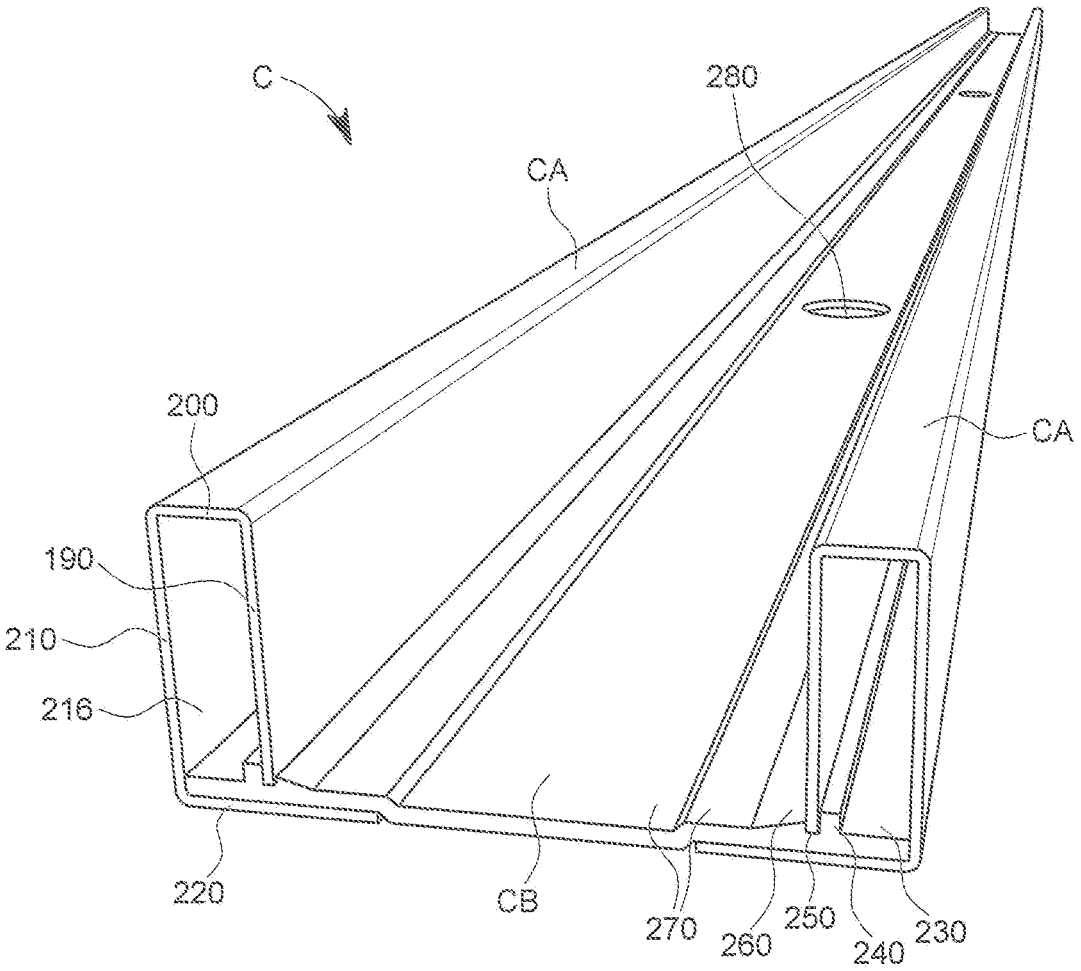
FIG. 4 is a 3D isometric plan view of a stud of the present application.

FIG. 4 shows embodiment stud C having nailing flange CA and web CB. Nailing flange CA is comprised of inner nailing flange 190, return 200, outer nailing flange 210 and base 220 with space 216 located within. Isolator web CB has outer stop 230, inner stop 240, trough 250, ramp 260, and base 270 and holes 280. With isolator web CB inserted between two nailing flange CA's the attachment to web isolator CB is made by inner nailing flange 190 bending down until it strikes ramp 260 forcibly moving inner nailing flange 190 upwards by bending all components of nailing flange CA until inner nailing flange 190 passes ramp 260 and enters trough 250 to rest. This process locks nailing flanges CA to web isolator CB permanently to make stud C. Web isolator CB may be segmented and not full length of stud C so that holes 280 are replaced by gaps (not shown) between web isolator segments CB. Base 270 may be cut with a radius to better represent holes 280 on one or both sides.

Figure 5:
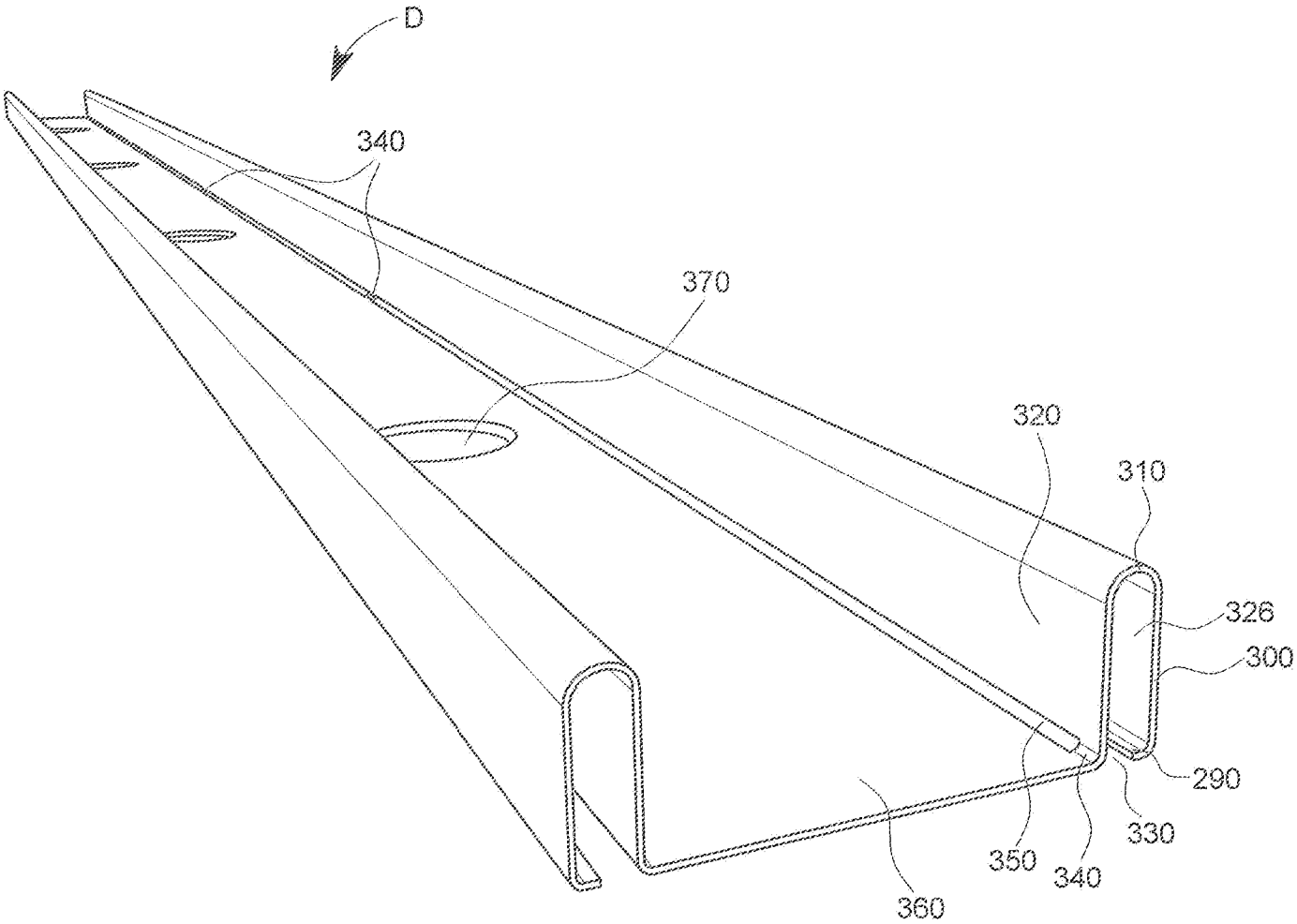
FIG. 5 is a 3D isometric plan view of another embodiment of the stud of this application.

FIG. 5 shows stud D having stop 290, outer nailing flange 300, return 310, inner nailing flange 320, space 326, gap 330, tab 340, extended slot 350, web 360 and holes 370. Final bends are made at tabs 340 allowing minimal contact between nailing flanges 300 and 320 and web 360 to help prevent vibration and thermal transfer from one side of the wall to the other.

Figure 6:
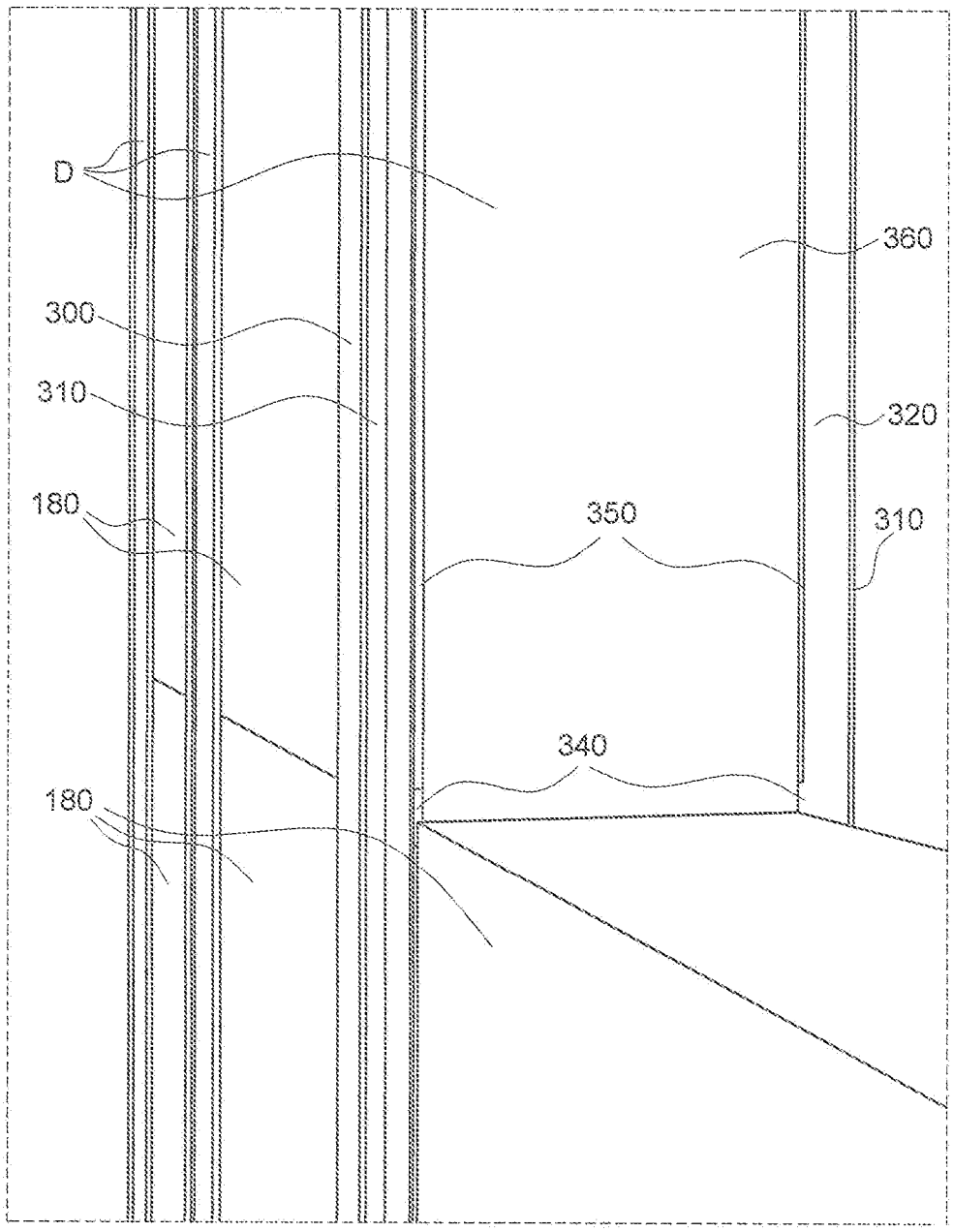
FIG. 6 is a 3D isometric elevation view of the stud of FIG. 5 in a wall assembly with the insulation installed, better depicting the significant de-coupling of the web from the dual flanges at each side.

FIG. 6 shows studs D with insulation 180 mounted between them where insulation 180 pushes to fill extended slots 350. Insulation 180 also helps prevent nailing flanges 300 and 320 from moving when being fastened to due to the compressive strength of insulation 180.

Figure 7:
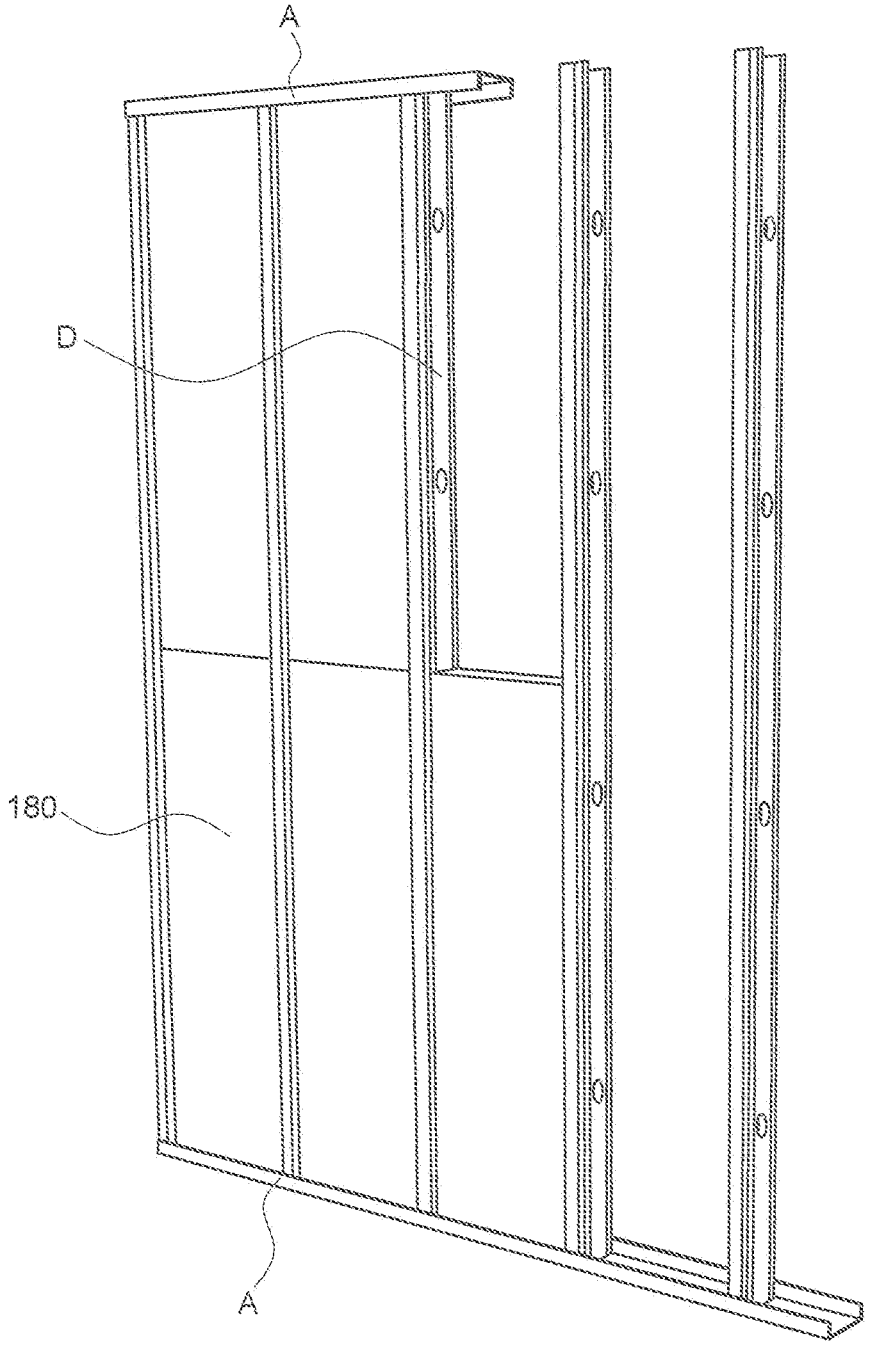
FIG. 7 is a 3D isometric elevation view of FIG. 6 at a distance showing more of the wall section with installed insulation.

FIG. 7 shows FIG. 6 from farther away with track A at the top and bottom. Track A may or may not have support AB depending on the application.

Figure 8:
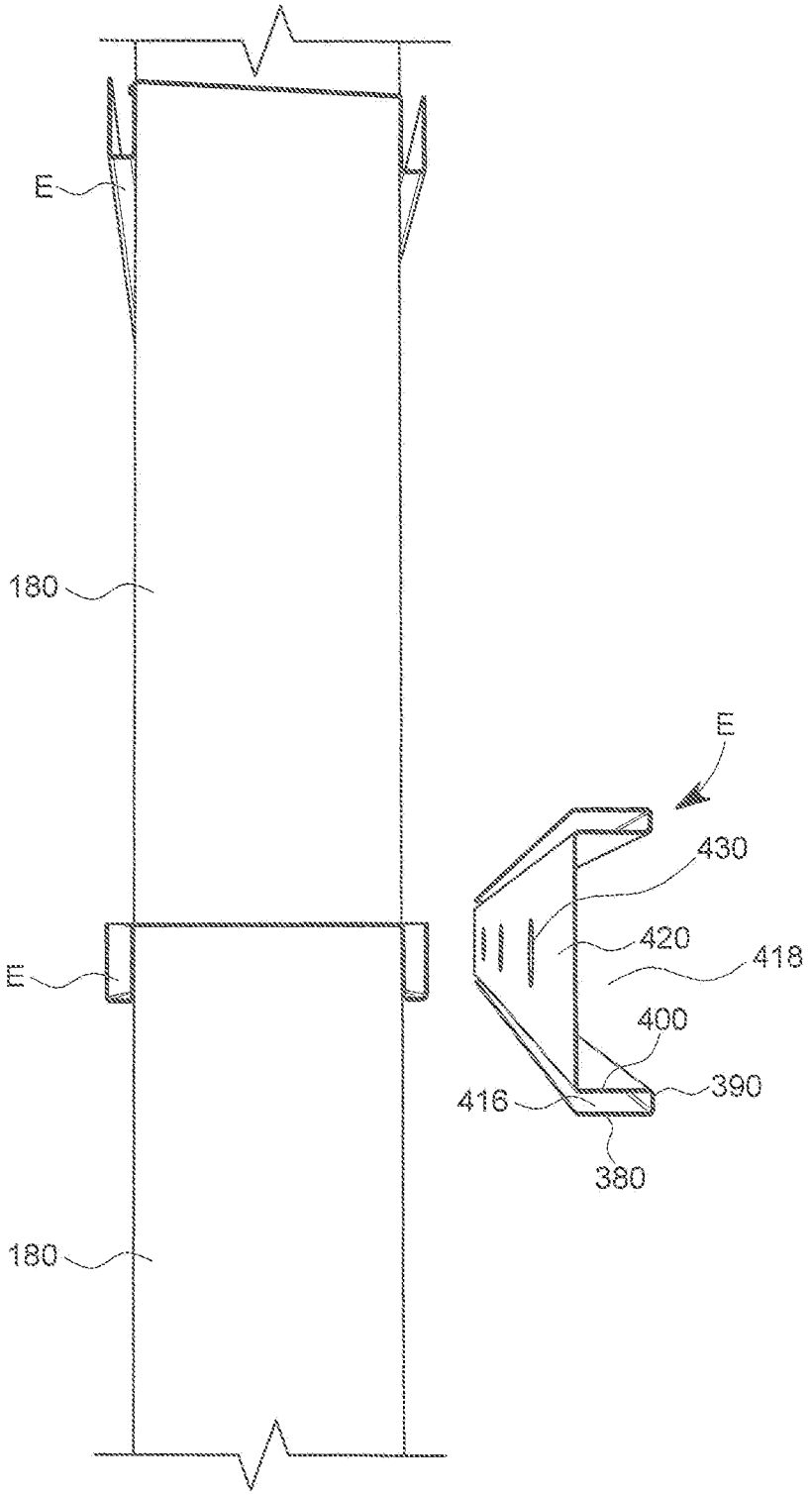
FIG. 8 is a 3D isometric plan view of another stud of the present invention showing the profile off to one side as well as with the insulation installed between the studs.

FIG. 8 shows stud E having outer nailing flange 380, return 390, inner nailing flange 400, space 416, web 420 and holes 430. Gap 418 is used to hold the insulation in place on one side of stud E while flange (not shown) at hole 430 protrudes out to hold insulation 180 on the opposite side of stud E.

Figure 9:
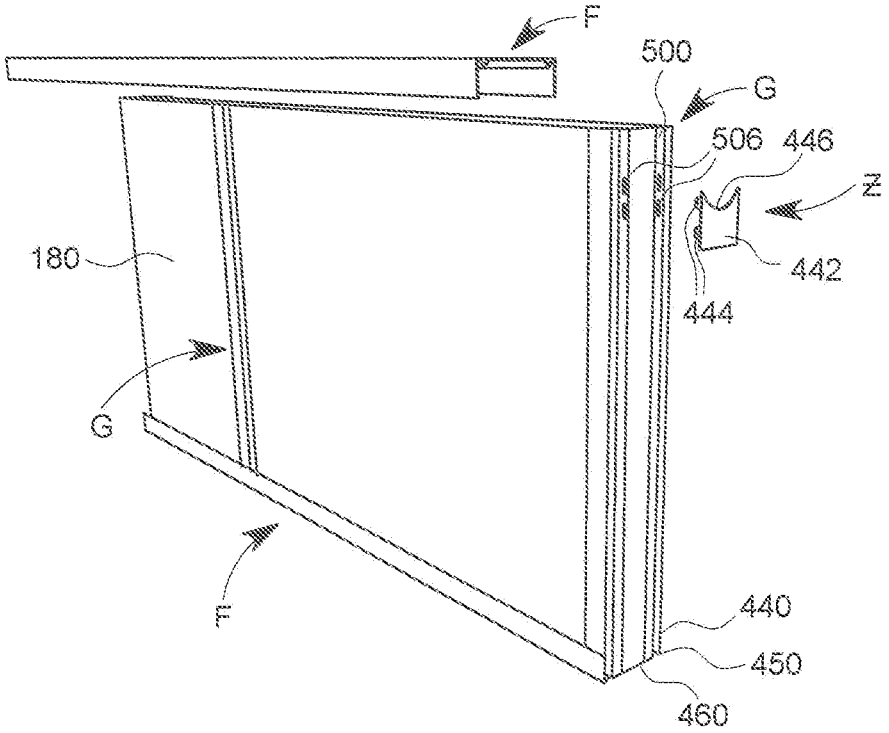
FIG. 9 is a 3D isometric elevation view of a short wall assembly with the top plate and brace not yet installed, where the studs are completely decoupled from each other. The studs are shaped to mate with the top and bottom plate so that they can't move perpendicular to the top and bottom plates.

FIG. 9 shows track F having flange 440, spike 450 and web 460. Stiffener Z has body 442, attachments 444 and saddle 446. Stud G is located on spikes 450 so that they may not move perpendicular to track F and fastened (not shown) to tracks F at the top and bottom of the wall assembly. Stud G is comprised in part of web 500 and slots 506. Slots 506 are in numerous places along stud G and are attachment holes for attachments 444 of stiffener H. Stiffener Z is used to hold studs G together at a specific distance, stiffen between them, and allow for other components (not shown) such as conductors and pipes to rest on them through a wall assembly.

Figure 10:
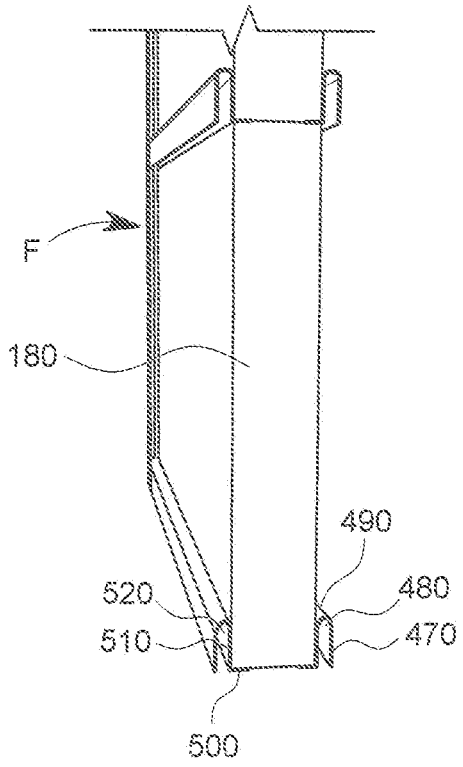
FIG. 10 is a 3D isometric plan view of the assembly of FIG. 9 showing the studs and how they interact with the tracks and insulation, leaving a gap once the drywall is installed.

FIG. 10 further shows stud G having outer nailing flange 470, spike notch 480, return 490, web 500, inner nailing flange 510 and space 520. Spike 450 inserts into spike notch 480 so that stud G can only move parallel with track F until it's permanently fastened to track F. Insulation 180 is shown between webs 500 of studs G so that it compresses to webs 500 and is partially confined between them. Alignment holes (not shown) may be used at any bend.

Figure 11:
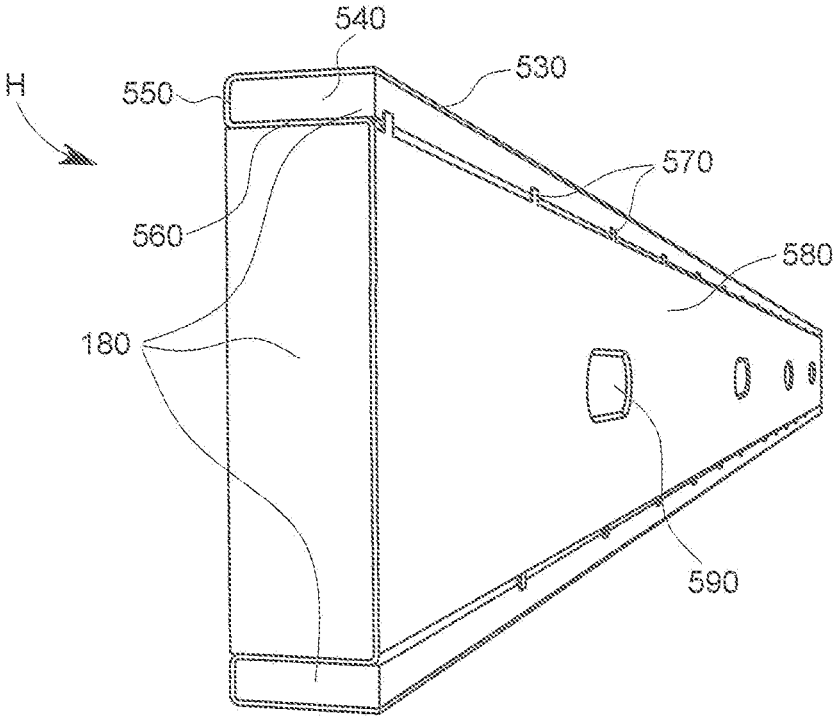
FIG. 11 is a 3D isometric plan view of another stud of the present invention having insulation installed between the cavities of the stud, holding the insulation in place with tabs that protrude outwards at the bends from pre-cut-out locations when the bends were formed.

FIG. 11 shows stud H having outer nailing flange 530, space 540, return 550, inner nailing flange 560, tabs 570, web 580 and holes 590. Tabs 570 are made by punching out a "U" shape in the metal (not shown) prior to forming so that when a bend (not shown) is made the inner portion of the "U" shape does not bend with the rest allowing it to remain straight and extending into space 540 as shown. Insulation is shown fastened within stud H.

Figure 12:
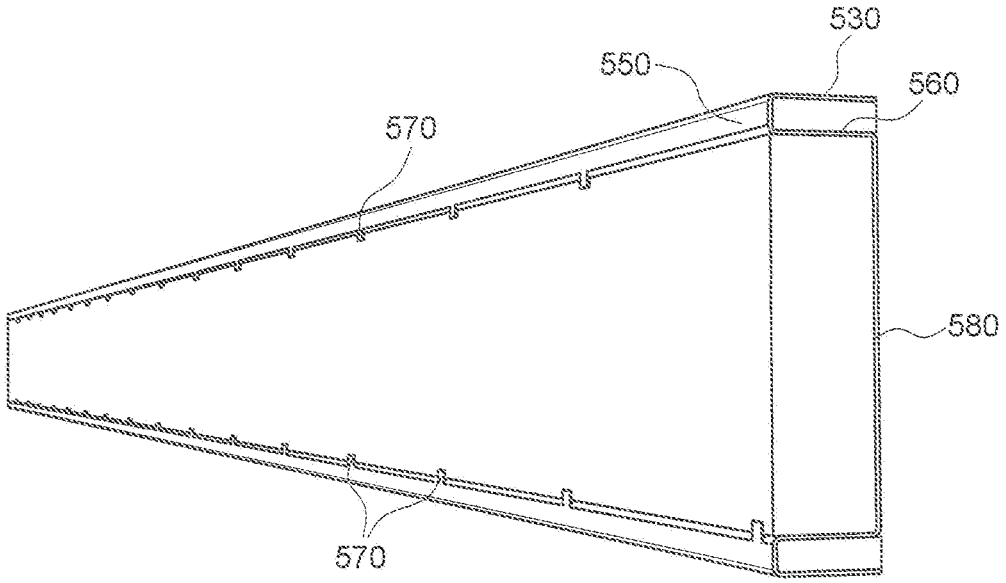
FIG. 12 is a 3D isometric plan view of the stud of FIG. 11 showing the opposite side.

FIG. 12 shows stud H of FIG. 11 on the opposite side with insulation 180 trapped via tabs 570 during the roll forming process. Aligned tabs 570 may constitute a bending means like aligned slots in previous embodiments. Insulation 180's compressive strength allows rigidity of stud H when pressure is applied to it such as during fastener installation (not shown).

Figure 13:
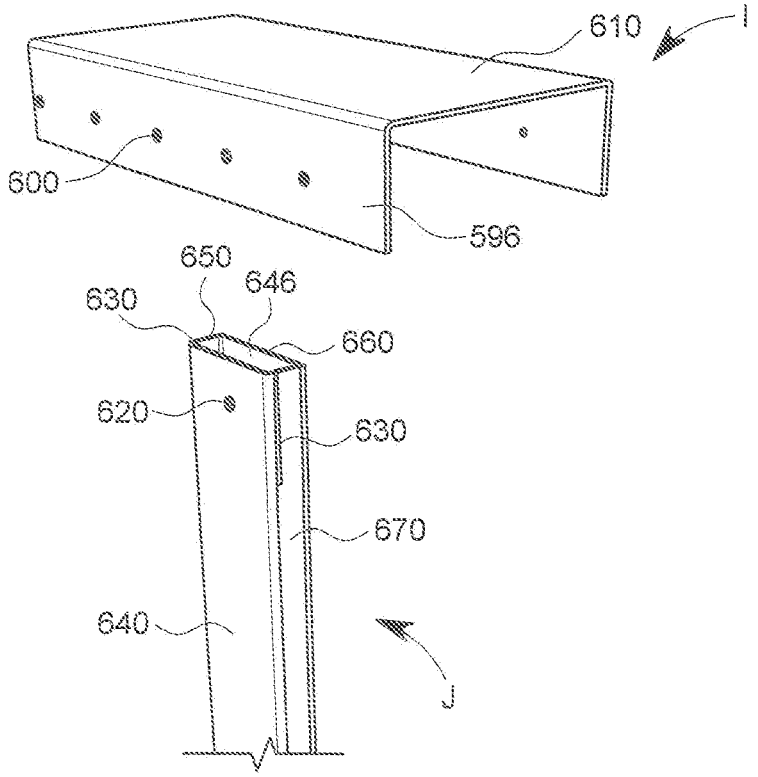
FIG. 13 is a 3D isometric elevation view of a decoupled stud and track of the present invention where the stud is slotted to fit over the flange of the track so that when aligned in the correct location, the male dimple in the stud will enter the female dimpled slot (shown as a regular dimple) so that no fastener is needed to hold the stud in place.

FIG. 13 shows track I having flange 596, female dimple slot 600 and web 610. Preferred embodiment of Stiffener Z is not shown in this drawing.

Stud J is comprised of dimple 620 located on outer nailing flange 640. Slots 630 are located between returns 650 and 670 adjacent to outer nailing flange 640. Inner nailing flange 660 causes a "rectangle" shape providing space 646. When slots 630 of stud J are installed over flange 596 of track I, the male dimple 620 of stud J inserts into female dimple slot 600 of track I so that track I allows a range of vertical motion for ceilings (not shown) that aren't perfectly flat, leaving a gap (not shown) between stud J and track I if needed.

Figure 14:
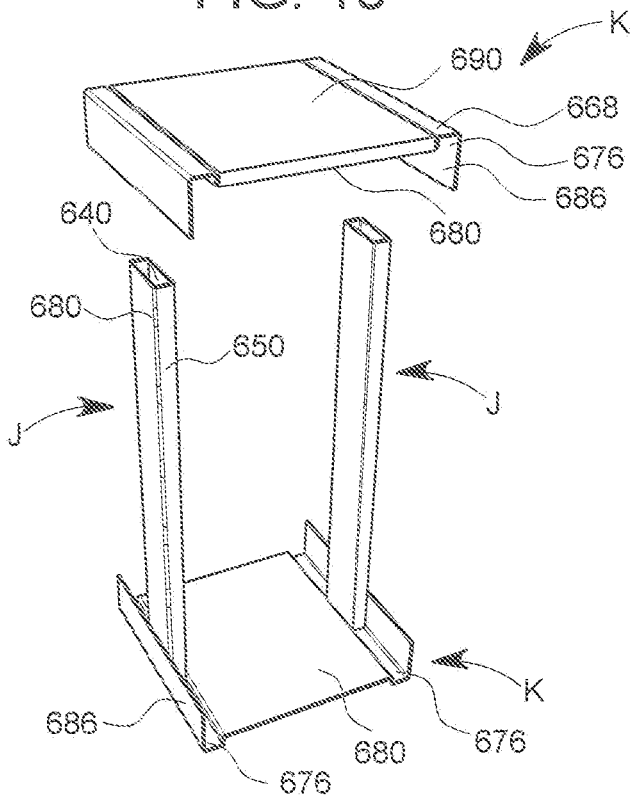
FIG. 14 is a 3D isometric view of the stud of FIG. 13 shown fitting inside of a track with channels inside to prevent the stud from moving perpendicular to the tracks.

FIG. 14 shows stud J of FIG. 13 used with track K. Track K consists of flange 686, trough 676, web 680, return 668 and spacer 690. Stud J rests within trough 676 within track K to prevent stud J from moving perpendicularly within track K when installed and prior to permanent fastening (not shown). Spacer 690 is a plastic, rubber or caulking type of isolator to remove air gaps (not shown) between track K and the floor or ceiling (not shown) to prevent vibration and thermal transfer from one side of a wall (not shown) to the other.

Figure 15:
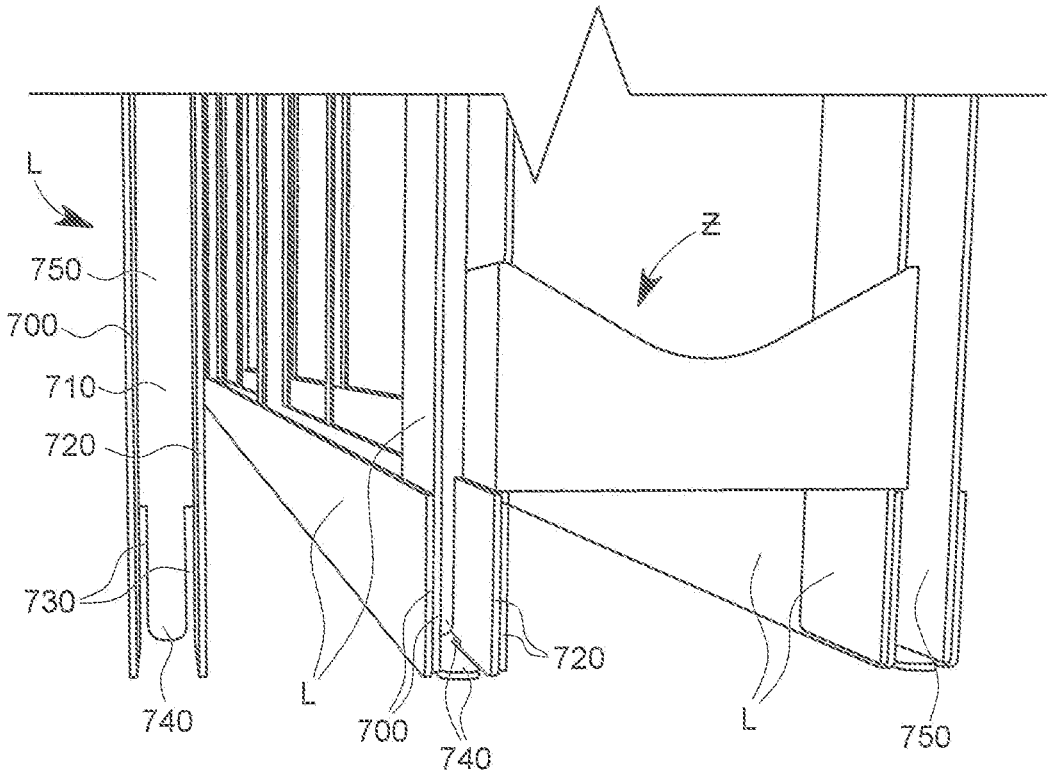
FIG. 15 is a 3D isometric elevation view of a decoupled stud of the present invention that fits onto itself so that no track is needed. This type of system creates two or more separate "mini" frames that allow for 100% continuous insulation between the two frames. The upper and lower tracks are fastened to the floor and ceiling as normal at specified distances using braces in certain locations to hold the correct separation in all locations.

FIG. 15 shows stud-track L used as both stud and track. Stud L is comprised of outer nailing flange 700, return 710, inner nailing flange 720, slots 730, finger 740 and space 750. When stud-track L is used as a track it's laid down horizontally and mechanically fastened to the floor and ceiling (not shown) in sequence as needed. When stud-track L is used as a stud it's positioned perpendicular onto the track (as shown) having slots 730 engage inner nailing flange 720 as shown prior to mechanical fastening (not shown). Slots 730 may also engage outer nailing flange 700 so that stud-track L is external of the track by either the thickness of outer nailing flange 700 with finger 740 within space 750 of the track, or so that finger 740 if fully external of the track. Two framed walls as shown provide a fully decoupled wall assembly providing a soundproof wall assembly when insulation (not shown) is used between the frames assemblies. Stiffener Z may be used to hold specific distances between stud-tracks L as well to add rigidity if necessary. Stiffener Z may be an isolator that's permanently fixed to stud-tracks L.

Figure 16:
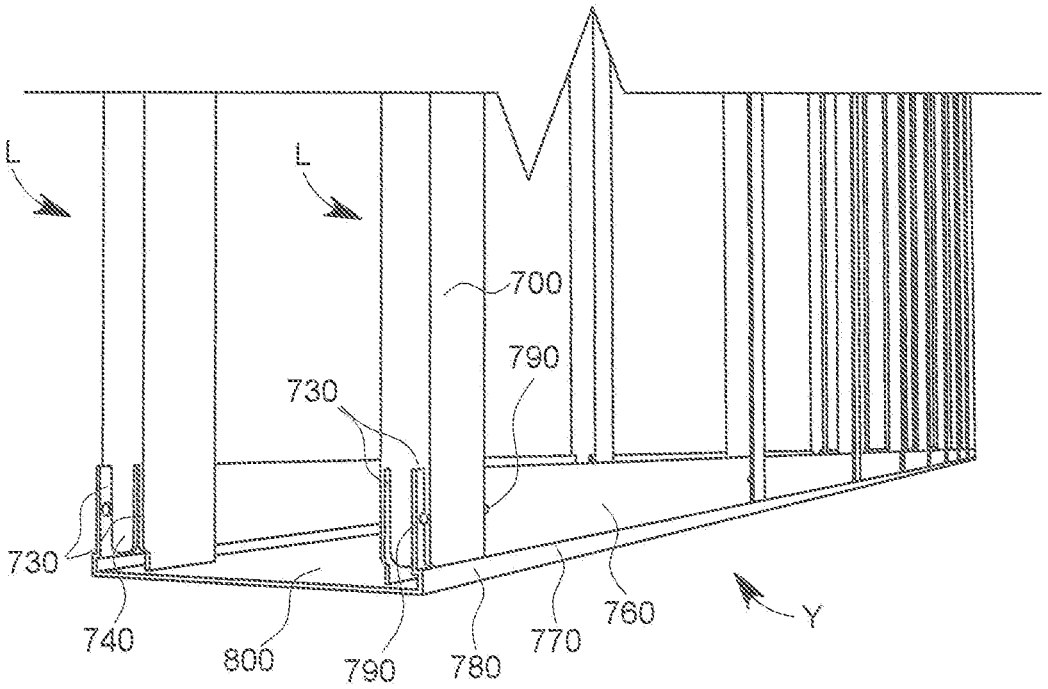
FIG. 16 is a 3D isometric elevation view of the stud of FIG. 15 used in a track that allows the studs to be mounted partially external of the track so that the entire outer wall of the frame is flush where it would normally have an offset because of the additional metal of the track.

FIG. 16 shows stud-track L used with alternate track Y. Track Y having upper flange 760, shelf 770, lower flange 780, dimples 790 and web 800. Stud-track L may be positioned over upper flange 760 and between dimples 790 which would be located on both sides of outer nailing flange 700 so that once it's installed in position it can't easily move to deny the need for mechanical fasteners until drywall (not shown) is added to complete the fixing.

Figure 17:
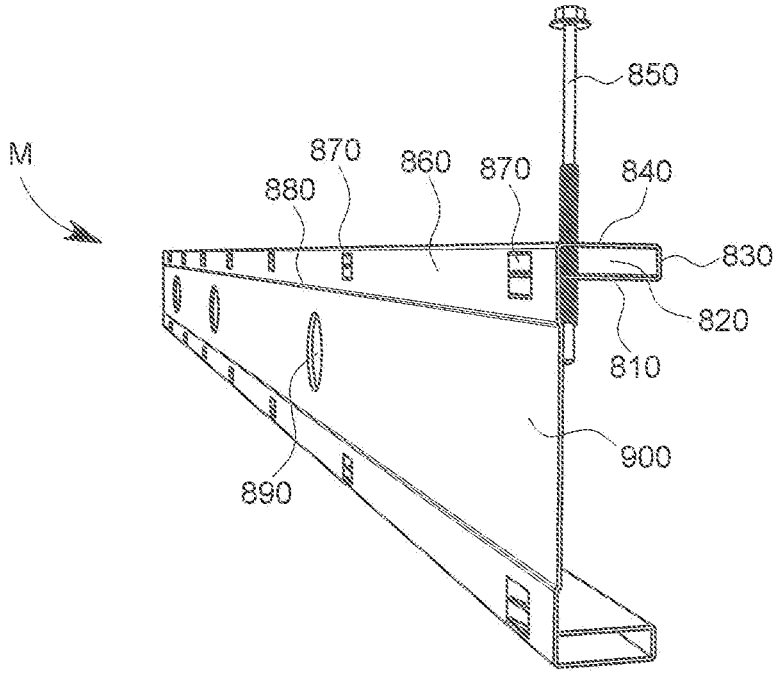
FIG. 17 is a 3D isometric plan view of a stud of the present invention that provides a means to prevent the final bent flanges from moving by utilization of smaller bent flanges that can be either parallel or perpendicular to the length of the stud.

FIG. 17 shows stud M having inner nailing flange 810, space 820, return 830, outer nailing flange 840, outer web 860, double U notches 870, crease 880, hole 890 and web 900. Regarding attributes of all previous stud embodiments, this one includes creases 880 to help stiffen webs 860 and 900. It also provides for double U notches 870 for permanent fixing of the location of inner nailing flange 810 as will be shown in FIG. 18. Screw 850 is shown penetrating outer nailing flange 840 and inner nailing flange 810 so that cantilevered loads (not shown) may be placed upon screw 950 far away from stud M with deflection of screw 950 dependent in part on it's material make-up, exposed distance from stud M, diameter, and angle into stud M.

Figure 18:
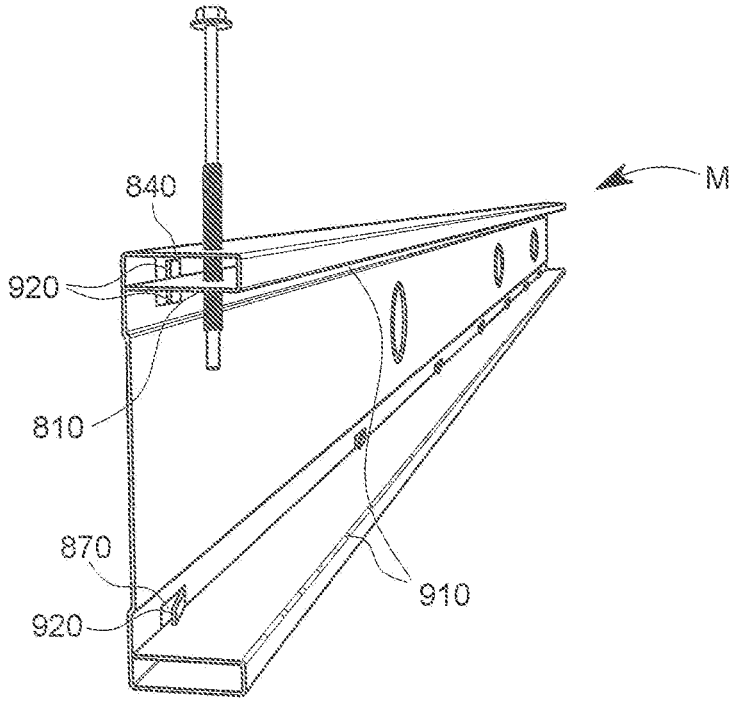
FIG. 18 is a 3D isometric plan view of the stud of FIG. 17 showing it from the opposite side, better depicting the screw that penetrates both flange walls so that the screw then becomes able to hold cantilevered loads far away from the outer wall if needed.

FIG. 18 further shows stud M of FIG. 17 having aligned slots 910 allowing for inner nailing flange 810 to be bent into position from external tooling only (rollers in a roll forming system, not shown) so that tabs 920 are pushed into the stud (via small diameter rollers on a roll forming machine (not shown)) and adjacent to both sides of inner nailing flange 810 so that they won't allow inner nailing flange 810 to move perpendicularly to stud M's length when external forces such as from adding mechanical.

Figure 19:
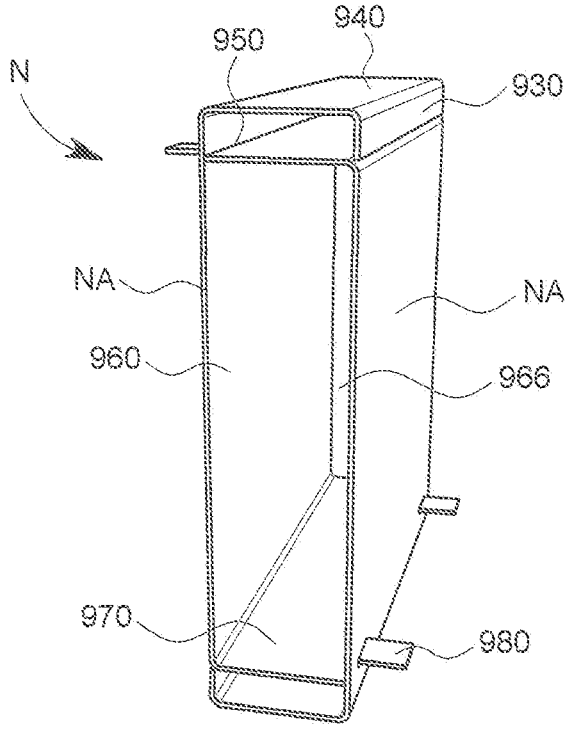
FIG. 19 is a 3D isometric plan view of a section of a stud of the present invention where two identical pieces are coupled together to make a single stud, tabs bent over on all sides.

FIG. 19 shows box stud N comprised of two identical studs NA. Studs NA studs are comprised of return 930, nailing flange 940, slots 950, web 960, nailing flange 970 and tabs 980. When tabs 980 are inserted into slots 950 of the opposing stud NA they combine to make one box stud N. Tabs 980 may then be bent over for permanent fixing and creating a set of two inner and outer nailing flanges as well as an inner cavity 966, all of which can be insulated (not shown).

Figure 20:
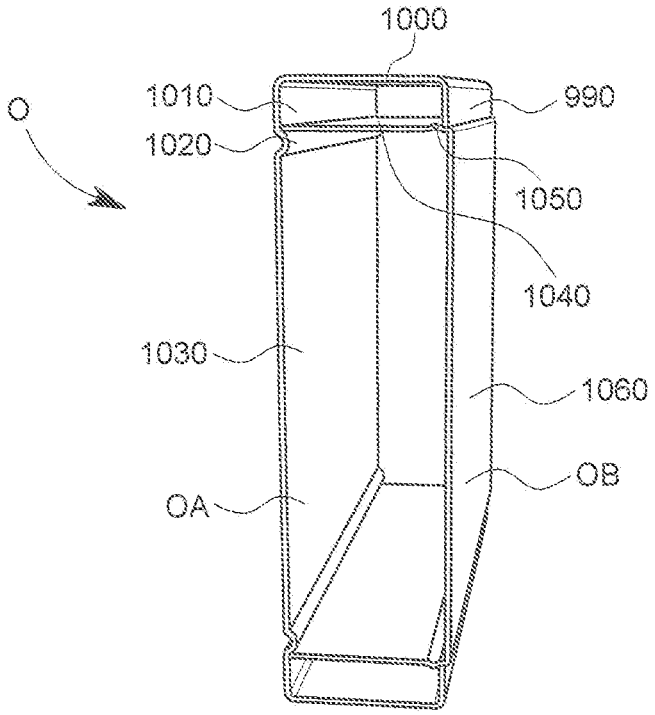
FIG. 20 is a 3D isometric plan view of a section of a stud of the present invention where two different pieces are coupled together to make a single stud once they snap together. If insulation that is substantially cut through at the locations of the male piece and inserted into the female piece, the male piece will follow the separation causing the insulation to expand into all spaces of the female piece to remove all air pockets.

FIG. 20 shows box stud O having separate studs OA and OB which snap together to make one box stud O. Stud OA is comprised of return 990, nailing flange 1000, outer web 1010, indent 1020 and web 1030. Stud OB is comprised of nailing flange 1040, outdent 1050 and web 1060. When outdents 1050 snap in position between returns 990 it locks OA and OB together. Indent 1020 prevents nailing flanges 1040 from moving when fasteners are installed into both nailing flanges of box stud O.

Figure 21:
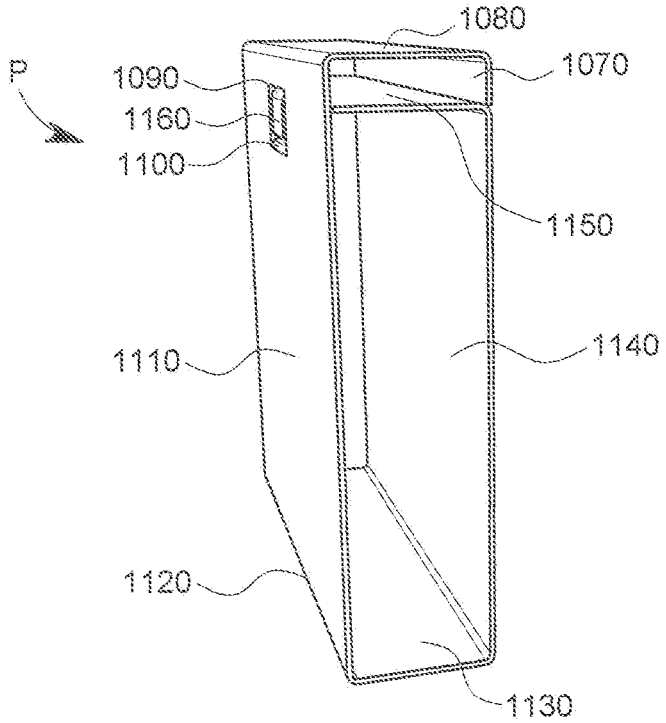

FIG. 21 shows box stud P having return 1070, outer nailing flange 1080, slot 1090, indent 1100, web one 1110, aligned slots 1120, nailing flange 1130, web two 1140, inner nailing flange 1150 and tab 1160.

Figure 22:
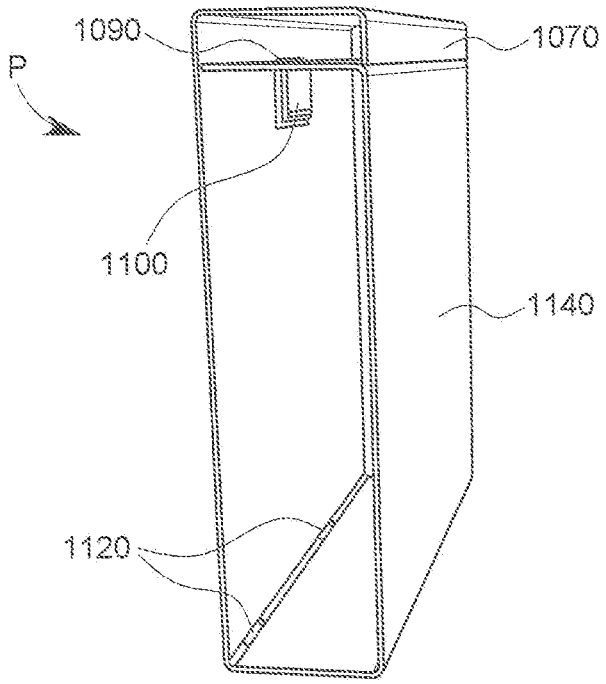
FIG. 22 is a 3D isometric plan view of the stud of FIG. 21 shown from the opposite side better indicating the aligned slots that allow the final bend without internal forming tooling.

FIG. 22 shows box stud P of FIG. 21 on the reverse side.

Figure 23:
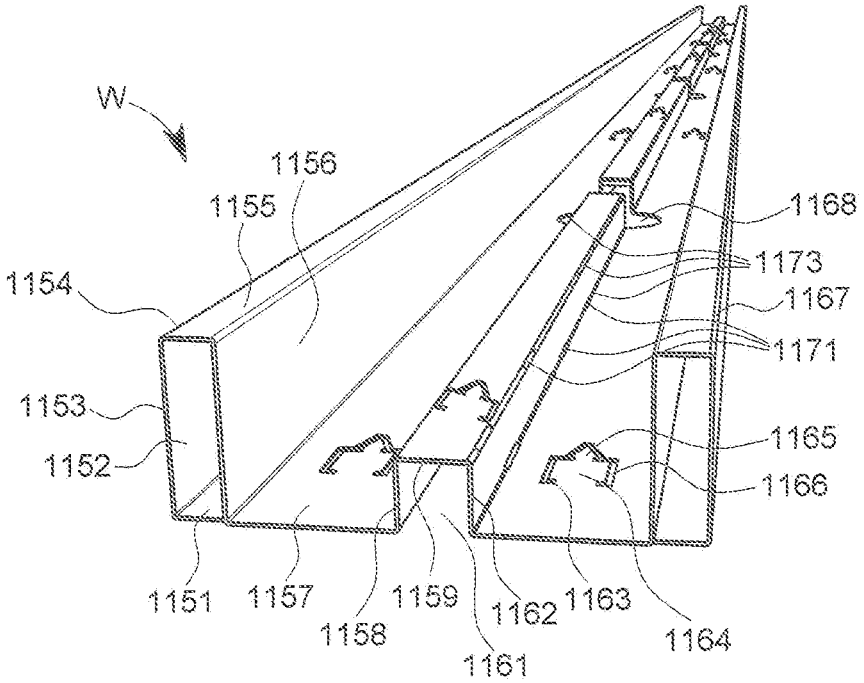
FIG. 23 is a 3D isometric plan of a stud of the present invention with a vibration stopping means in the middle of the stud to prevent vibration from traveling from one side of the stud to the other plus insulation impaling pins built into the stud.

FIG. 23 shows stud W having return 1151, space 1152, outer nailing flange 1153, gusset 1154, return 1155, inner nailing flange 1156, web 1157, vibration reducing verticals 1158 and 1162, vibration reducing horizontal 1159, space 1161, bend punch-out 1163, large tab 1164, small tab 1165, shaped punch out 1166, aligned slots 1167, service hole 1168, offset vibration slot holes 1171 and vibration dampening bends 1173. Different from the other studs is shaped punch out 1166 providing a skeleton for large tab 1164 and small tab 1165 which may be bent upwards at reduced width location provided by bend punch outs 1163. Once bent up insulation (not shown) may be impaled over the skeleton. Once the insulation (not shown) is installed small tab 1165 may be bent over the insulation to prevent it from departing stud W. Offset vibration slot holes 1171 are used at all 4 vibration dampening bends 1173 (three are shown, one is hidden), which are offset from one another to eliminate direct path of vibration (not shown) from one side of stud W to the other. Service hole 1168 is punched as an obround shape with eased edges (not shown, to reduce abrasive contact to other materials passing through) prior to forming, becoming substantially round once formed.

Figure 23A:
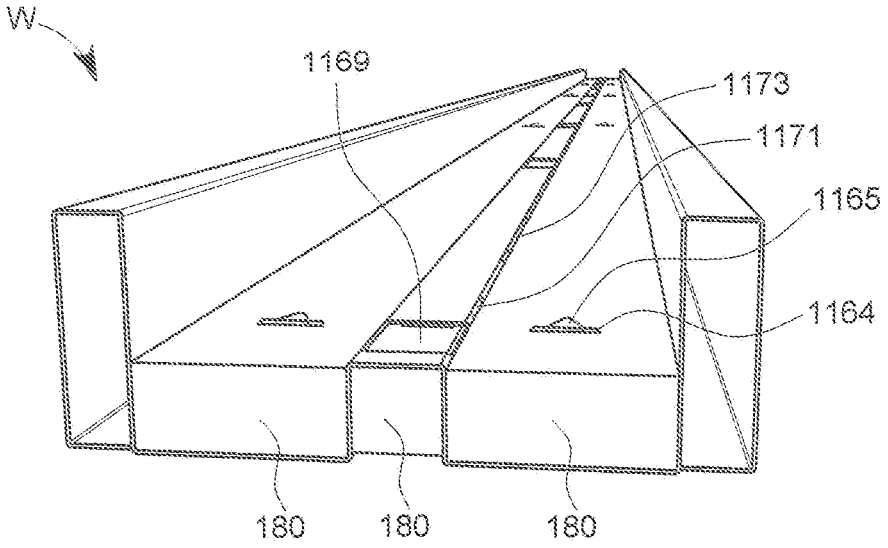
FIG. 23A is a 3D isometric plan view of the stud of FIG. 23 with insulation installed onto the insulation impaling pins.

FIG. 23A shows stud W of FIG. 23 with insulation 180 captured within stud W having small tabs 1165 bent over the top in multiple locations. Shaped punch out 1166 becomes open area 1169 when large tab 1164 and small tab 1165 are repositioned as shown. Insulation 180 removes air from within stud W to prevent noise (vibration, not shown) from being able to pass from one side of stud W to the other, absorbing vibration in those locations so further insulation 180 (not shown) can butt up to insulation 180 within stud W.

Figure 23B:
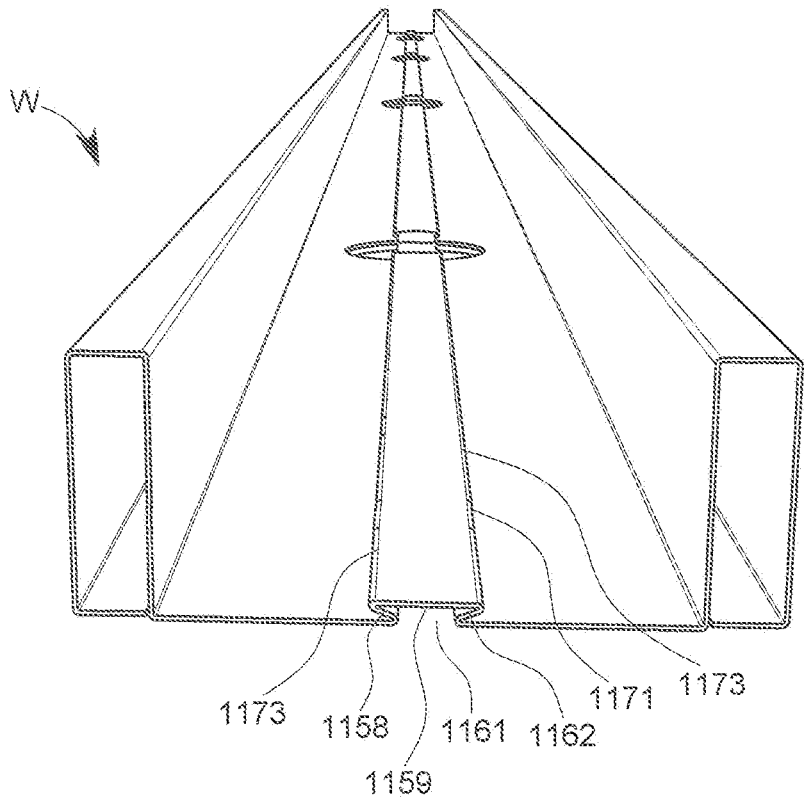

FIG. 23B shows stud W of FIG. 23 having space 1161 substantially eliminated by overbending vibration dampening bends 1173 at offset vibration slot holes 1171. Offset vibration slot holes 1171 prevent a direct path for vibration (not shown) to pass from one side of stud W to the other, and vibration dampening bends 1173 turn the vibration (not shown) back into the direction it came from (not shown) to be absorbed in the installed insulation (not shown). Additional holes (not shown) may be made in stud W for the purpose of additional stiffening from one stud W to the other, attaching the stiffening member (not shown) to return 1151 and 1155. Acoustic vibration tape (not shown) may be placed around the areas of vibration dampening bends 1173 and other locations of stud W as needed.

Figure 23C:
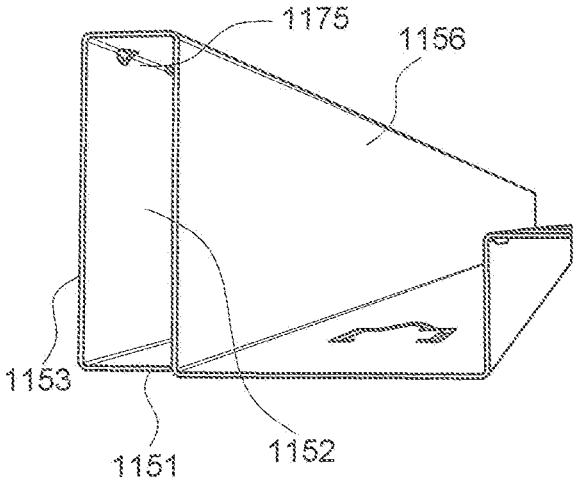
FIG. 23C is a 3D isometric plan view of the stud of FIG. 23 showing a gusset.

FIG. 23C shows stud W of FIG. 23 showing gusset 1175 on the inside of space 1152. Gusset 1175 stiffens any bend with or without alignment slot holes 1167.

Figure 23D:
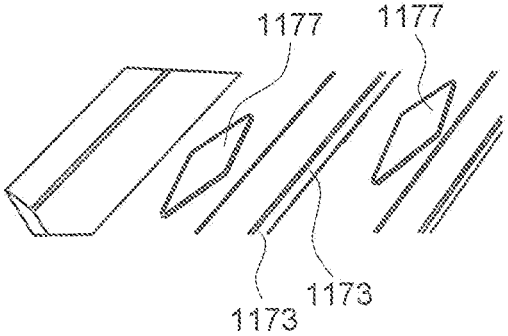
FIG. 23D is a 3D isometric plan view of the stud of FIG. 23 having offset stamped indentations to help dampen vibration, located anywhere on stud W.

FIG. 23D shows stud W of FIG. 23 having offset stamped indentations 1177 to help dampen vibration, located anywhere on stud W.

Figure 24:
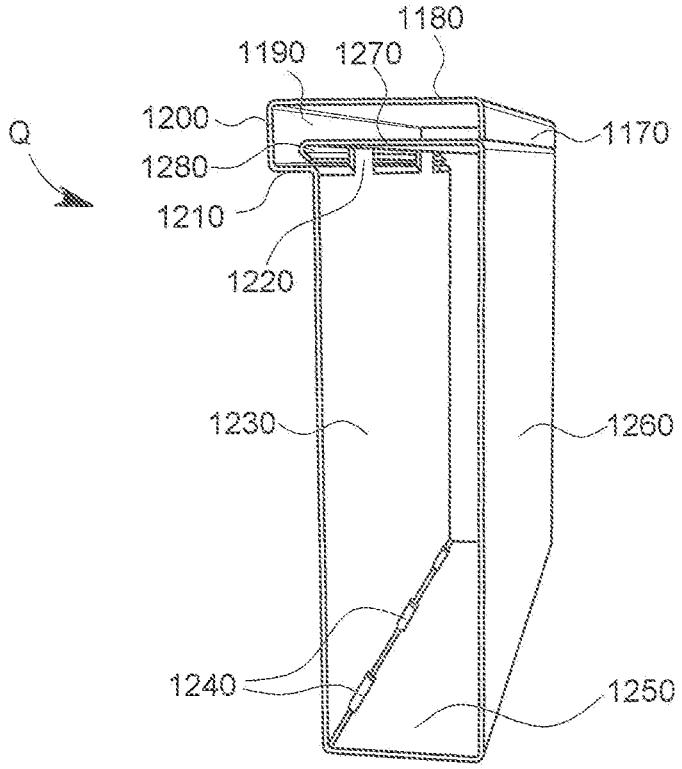
FIG. 24 is a 3D isometric plan view of a stud of the present invention made of one sheet of metal that allows it to snap into itself to create the final product, having double nailing flanges on one side and a single nailing flange on the other side.

FIG. 24 shows box stud Q having return 1170, outer nailing flange 1180, space 1190, return 1200, shelf 1210, tab 1220, web one 1230, aligned slots 1240, nailing flange 1250, web two 1260, inner nailing flange 1270 and hook 1280. When made in a roll forming process like other studs of this invention, the aligned holes 1240 is the last bend allowing for hook 1280 to pass inside of return 1170 without contacting it and be forcibly pushed over tabs 1220 so that once over hook 1280 will rest on tabs 1220 that were made using U shaped punch-outs (not shown) noted in previous studs.

Figure 25:
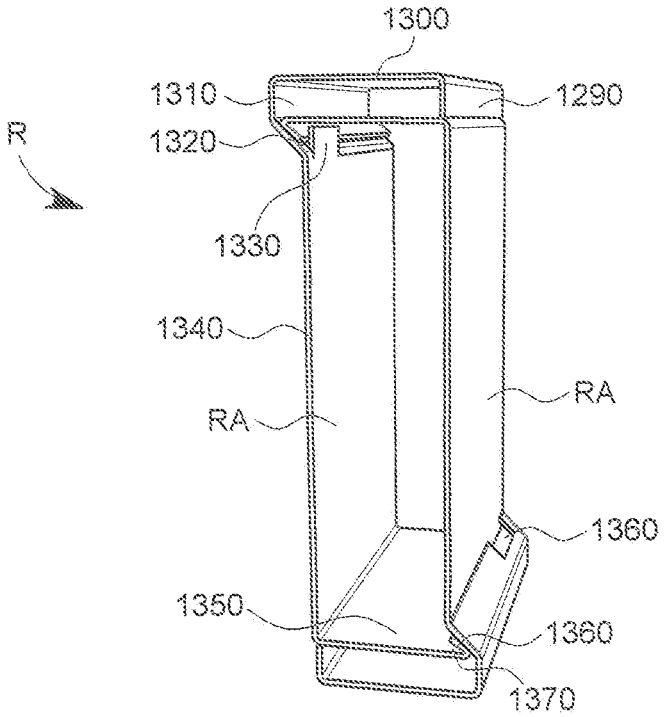
FIG. 25 is a 3D isometric plan view of a stud of the present invention made of two identical pieces that when snapped together create a single double flanged stud, however they could be used separately as single flanged studs.

FIG. 25 shows box stud R which is composed of two identical studs RA which are comprised of return 1290, nailing flange 1300, return 1310, bevel 1320, tab 1330, web 1340, nailing flange 1350, hook arm 1360 and hook 1370. Frictionally fit together studs RA interconnect by hook arms 1360 being forcibly pushed over tabs 1330 to affix together one box stud R.

Figure 26:
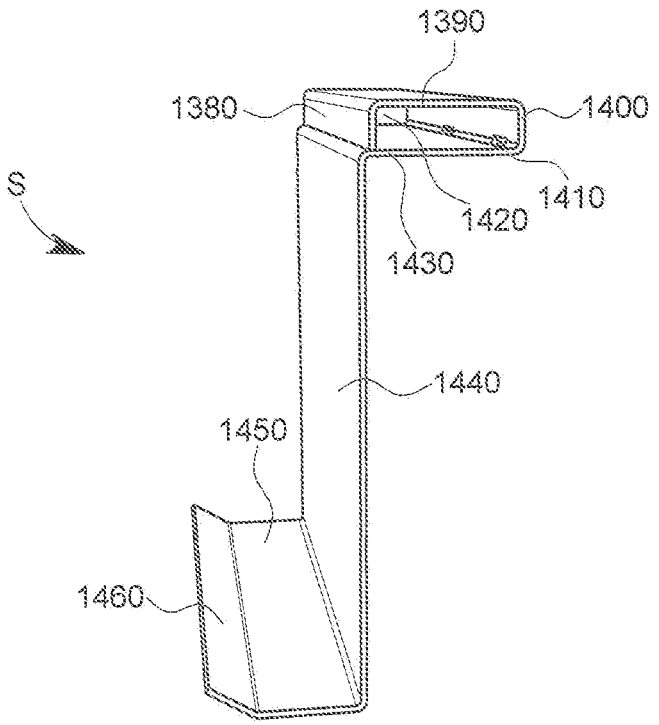
FIG. 26 is a 3D isometric plan view of a purlin of the present invention where one side has a single flange and the other a double flange. The double flange supports itself from 2 sides so that when pressure from fastening or loads are applied it maintains it's rigidity. The process to form the part this way is unique in that it utilizes the bending characteristics of metal spring back to allow it to deform during forming and then return to its intended shape since the yield point of the metal will not be reached, and relying on the radius of the bend near the short support flange to allow the short flange to bend past it and then come back up and move back into a more structural position.

FIG. 26 shows purlin S comprised of return 1380, outer nailing flange 1390, return 1400, aligned slots 1410, space 1420, inner nailing flange 1430, web 1440, nailing flange 1450 and stiffening return 1460. Following similar roll forming processes (not shown) of previous studs, all bends are made with the last bend being made at the aligned slots using external pressure rollers which will cause the metal to deflect at returns 1400 and 1380 as well as outer nailing flange 1390 and the bends between them. This deflection will cause the end of return 1380 to extend beyond the radiused bend at web 1440 so that return 1380 moves somewhat parallel to web 1440 until the over-bend amount is met at aligned slots 1410 when the pressure rollers (not shown) back away and allow the metal to spring back (not shown) so that return 1380 rests in its permanent location and other portions return to their original shapes as depicted in the drawing.

Figure 27:
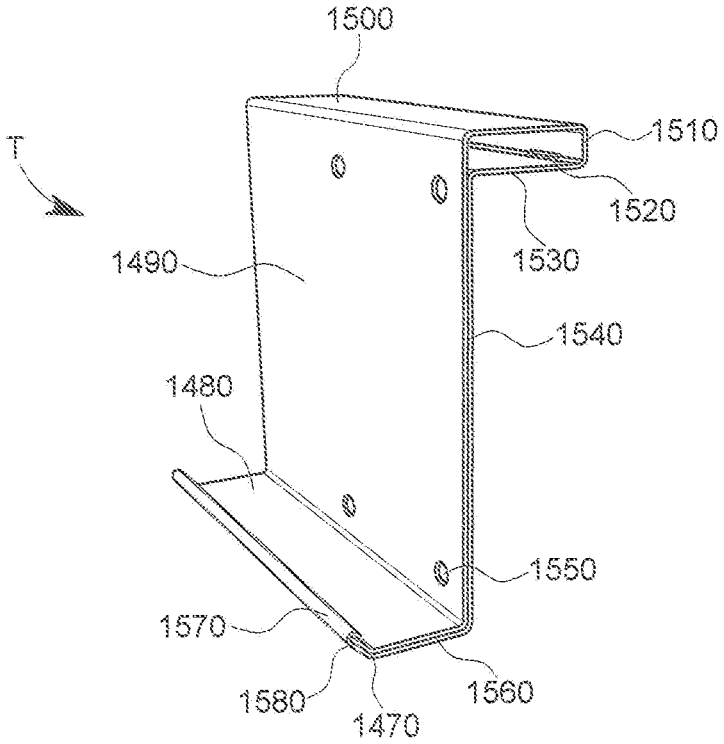
FIG. 27 is a 3D isometric plan view of a purlin of the present invention that is made of one piece and having the final bend allow it to fold over onto itself and snap into itself. Clinching the two flanges together provides for a very strong ply for heavier weights applied for roof conditions as well as a double nailing flange as well as a double layered attachment point on the single flange side.

FIG. 27 shows purlin T having ramp 1470, first nailing flange 1480, first web 1490, outer nailing flange 1500, return 1510, alignment holes 1520, inner nailing flange 1530, second web 1540, clinching 1550, second nailing flange 1560, hook 1570 and stiffening arm 1580. As with other studs roll forming is performed with the last bend being made at alignment slots 1520 so that ramp 1470 is pushed into hook 1570 and adjacent to stiffening arm 1580 to hold the general shape of purlin T. Clinching 1550 is performed to join webs 1490 and 1540. Clinching 1550 may be made in first and second nailing flanges 1480 and 1560.

Figure 28:
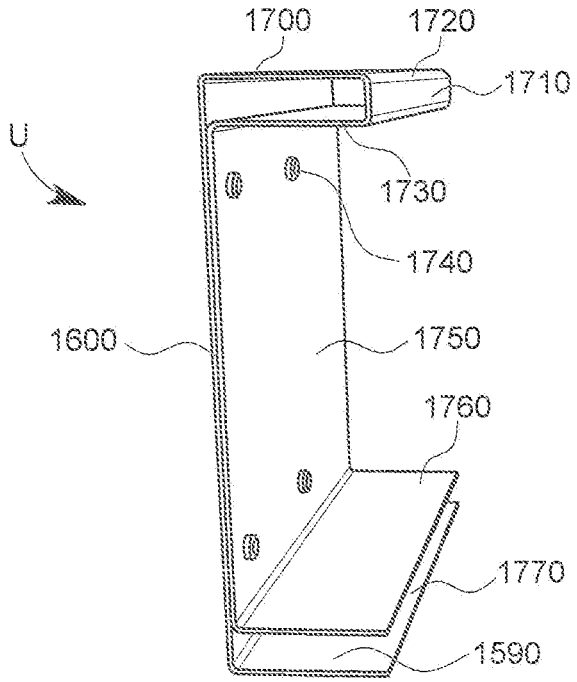
FIG. 28 is a 3D isometric plan view of a stud of the present invention having double flanges on each side that differ from each other so that cantilevered screws can support cantilevered loads on each side of the stud. The stud is made of one piece of sheet metal and clinched permanently together.

FIG. 28 shows stud U consisting of outer nailing flange 1590, web one 1600, outer nailing flange 1700, return 1710, aligned slots 1720 (not shown), inner nailing flange 1730, clinching 1740, web two 1750, inner nailing flange 1760 with space 1770 between inner nailing flange 1760 and outer nailing flange 1590 having no return on one side. The process to manufacture is the same as purlin T, however inner nailing flange 1760 and outer nailing flange 1590 have an open space between them. This configuration allows for stiffer loads (not shown) to be placed on the ends of the stud U without adding material to the dual nailing flanges. Return 1710 and alignment slots 1720 aren't needed to make a similar configuration as the opposite side and is considered obvious.

Figure 29:
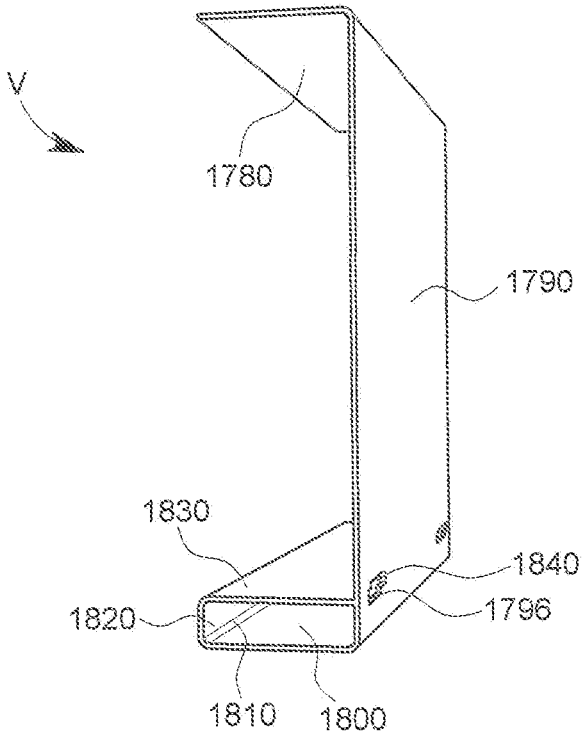
FIG. 29 is a 3D isometric plan view of a stud of the present invention with a double nailing flange on one side and a single flange on the other side. Tabs on the double nailing flange side enter slots and are bent over on the opposite side of the slots so that the shape is permanently held.

FIG. 29 shows stud V having nailing flange 1780, web 1790, outer nailing flange 1800, aligned slots 1810, return 1820, inner nailing flange 1830, tabs 1840 and slots 1796. Again, the final bend is made at alignment slots 1810 so that angled tabs 1840 matching the radius originating from alignment slots 1810 allow tabs 1840 to enter slots 1796 and then to be bent over to hold the shape of stud V.

While the foregoing embodiments of the application have been set forth in considerable particularity for the purposes of making a complete disclosure of the invention, it may be apparent to those of skill in the art that numerous changes may be made in such details without departing from the spirit and principles of the application. Additionally, combinations and interchangeability or inter-use of components and embodiments should be considered apparent to the spirit and principles of the application, and in which all terms are meant in their broadest, reasonable sense unless otherwise indicated. Any headings utilized within the description are for convenience only and have no legal or limiting effect.

The invention claimed is:

1. A cantilevered, decoupled and resilient framing system, said system comprising:

a unitary dual nailing flanged stud, said stud comprising a first closed end, a second closed end and a central web positioned therebetween, and further including:

a first inner nailing flange extends perpendicularly to a first return, said first return extends perpendicularly to a first outer nailing flange parallel to said first inner nailing flange creating a space therebetween, said first outer nailing flange extends perpendicularly to a first outer web, said first outer web extends to said central web, thereby defining the first closed end, a second inner nailing flange extends perpendicularly to a second return, said second return extends perpendicularly to a second outer nailing flange parallel to said second inner nailing flange creating a space therebetween, said second outer nailing flange extends perpendicularly to a second outer web, said second outer web extends to said central web, thereby defining the second closed end, a plurality of double U notches with inner tabs, provided along an entirety of a length of said first outer web and said second outer web, configured to permanently fix a location of said first inner nailing flange and said second inner nailing flange, a plurality of aligned slots located along an edge of each return, configured to allow said first and second inner nailing flanges to be bent into position from external tooling, so that said inner tabs are pushed into said stud and adjacent to both sides of said first and second inner nailing flange thereby to prevent movement of said first and second inner nailing flanges perpendicularly to length of said stud.

2. The system of claim 1, further comprises at least one fastener configured to penetrate via said first or second outer nailing flange, said first or second inner nailing flange, and through said space therebetween, in order to place cantilevered loads thereupon, away from said dual nailing flanged stud with deflection of said fastener.

3. The system of claim 1, wherein said stud further comprises a first crease along an entirety of a length between said first outer web and said central web, configured to help stiffen said first outer web and said central web.

4. The system of claim 1, wherein said stud further comprises a second crease along an entirety of a length between said second outer web and said central web, configured to help stiffen said second outer web and said central web.

5. The system of claim 1, wherein said stud further comprises a plurality of holes along an entirety of a length of said central web.

* * * * *